US008283539B2

(12) United States Patent
Landtroop

(10) Patent No.: US 8,283,539 B2
(45) Date of Patent: Oct. 9, 2012

(54) MUSICAL INSTRUMENT STRING WITH HYPER ELLIPTICAL WOUND COVER WIRE

(76) Inventor: Jeffrey E. Landtroop, Vicksburg, MI (US)

( * ) Notice: Subject to any disclaimer, the term of this patent is extended or adjusted under 35 U.S.C. 154(b) by 288 days.

(21) Appl. No.: 12/831,409

(22) Filed: Jul. 7, 2010

(65) Prior Publication Data

US 2011/0005365 A1 Jan. 13, 2011

Related U.S. Application Data

(60) Provisional application No. 61/224,954, filed on Jul. 13, 2009.

(51) Int. Cl.
*G10D 3/10* (2006.01)

(52) U.S. Cl. ..... 84/297 S

(58) Field of Classification Search ..... 84/297 S, 84/297 R

See application file for complete search history.

(56) References Cited

U.S. PATENT DOCUMENTS 4,581,976 A * 4/1986 Ball ..... 84/297 S
6,465,721 B2 * 10/2002 Landtroop et al. ..... 84/297 S
2006/0174745 A1 8/2006 D'Addario
2007/0084329 A1 4/2007 Allen
2008/0190642 A1 8/2008 Allen

FOREIGN PATENT DOCUMENTS

JP 2002515131 5/2002

OTHER PUBLICATIONS

PCT/ISA/210 for PCT/US2010/041594.
PCT/ISA/2237 for PCT/US2010/041594.

* cited by examiner

*Primary Examiner* — Kimberly Lockett
(74) *Attorney, Agent, or Firm* — Michael J. Hughes

(57) ABSTRACT

A musical instrument string with hyper elliptical wound cover wire includes a wound musical string assembly (10) having a center string (12) and a shaped cover wire (24) wrapped in a spiral winding pattern (18). The shaped cover wire (24) is shaped to have a wire height (30) which is greater than a wire width (32) and is wound such that the wire height (30) is aligned perpendicularly to the longitudinal axis (14) of the center string (12) while the wire sides (26) abut tightly against those of adjacent iterations (20). The shaped cover wire (24) is shaped during the winding process by passing between pinch rollers (38) while under extrusion pressure.

16 Claims, 3 Drawing Sheets

MUSICAL INSTRUMENT STRING WITH HYPER ELLIPTICAL WOUND COVER WIRE

This is a non-provisional application. It is based on and claims priority from the provisional application No. 61/224,954, filed 13 Jul. 2009, on behalf of the same inventor.

TECHNICAL FIELD

The present invention relates generally to musical instruments and particularly to strings for musical instruments with a center string and a winding of a cover wire.

BACKGROUND ART

Strings for musical instrument such as guitars, the viol family, pianos and the like come in many forms and are made from various materials. For the percussion type of stringed instruments, particularly guitars and pianos, lower tone strings are often of the wound type, with a central string being encompassed by a spiral wound cover wire. The use of a wound string improves tonal quality and can prevent degradation of the string caused by stretching.

Various winding techniques have been used over the years. As one example, the present inventor has previously developed a winding system for musical instrument strings as set forth in U.S. Pat. No. 6,465,721.

While various developments have occurred over the years, tonal and durability factors have not yet reached optimal results. Therefore, room for improvement in wound stings remains.

DISCLOSURE OF INVENTION

Accordingly, it is an object of the present invention to provide an improved winding system and cover wire for musical instrument strings.

Another object of the invention is to provide a wound cover wire having a greater linear density than existing strings.

A further object of the present invention is to provide a wound cover wire with a tighter and higher density spiral winding pattern, thus improving performance.

Yet another object of the invention is to provide a compound or wound musical string with greater mass and magnetic moment, thus improving pick-up in electric instruments.

A further object of the invention is to provide greater mass per length on the wound string, resulting in better overall tone, better mid-range, super harmonics, greater sustain, smooth easy feel and longer life.

Another object of the invention is to provide a string with a reduced linear dimension between adjacent cover wire wrap iterations, thus reducing finger noise, improving tone and maximizing outer wire contact with the center string.

Briefly, one preferred embodiment of the present invention is a shaping and winding system and method for producing wound or compound strings for musical instruments and the musical instrument string with hyper elliptical wound cover wire produced thereby. A cover wire winding system is utilized to apply a cover wire in a continuous tight spiral winding about a longitudinal extent of a central string. The system includes a pair of matched pinch rollers which shape the cover wire from its original circular cross section to an elliptical cross section with flattened sides. The resulting shaped cover wire is aligned such that the wire is wound about the center string with the flattened sides being adjacent in abutting wraps, thus reducing the effective spacing between adjacent wraps.

The improved string of the present embodiment includes a shaped cover wire having a generally hyper elliptical cross sectional shape with distinct flattened sides and having a greater wire height than wire width. The cover wire is wound about the center string with the sides aligned to abut during each iteration with the wire height aligned perpendicularly to the longitudinal axis of the center string. The improved wound string is characterized by having a high density spiral winding pattern.

An advantage of the present invention is that it provides a reduced pitch angle between adjacent windings and improves intonation.

Another advantage of the invention is that it provides a string with very consistent linear mass density which provides for a more even balance of harmonics.

An additional advantage of the invention is the mass of the cover wire and the wound string is increased without changing the diameter of the overall wound string or the material type of the cover wire.

Yet another advantage of the present invention is that the improved winding improves tonality and "feel" for the musician and reduces "finger noise".

A further advantage is that strings produced by the inventive method have fuller voicing with better tonal response across the full spectrum.

Still another advantage of the present invention is that it results in a more consistent and even winding pattern for a wound string.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 3:
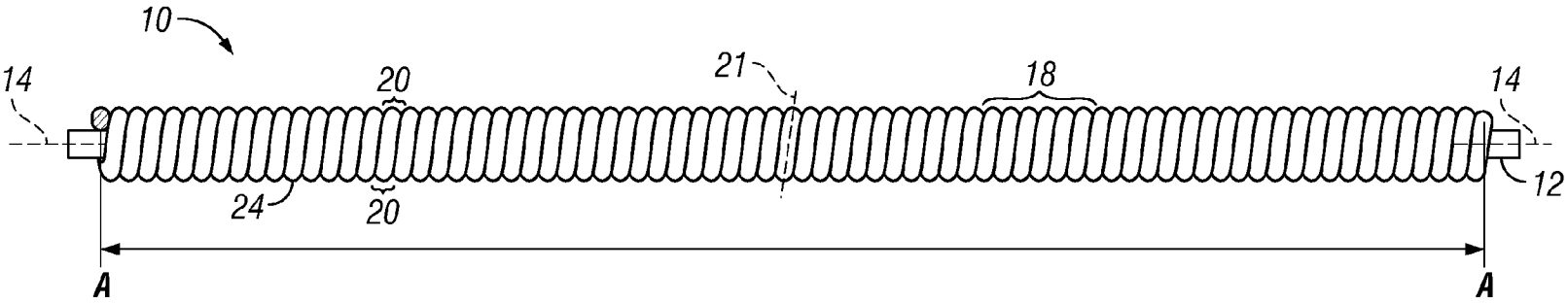
FIG. 3 is a side elevational view of a the improved wound string of the present invention using a shaped hyper elliptical cover wire.

The present invention is a method for creating an improved wound string for a musical instrument and a musical instrument string with hyper elliptical wound cover wire 10 which may be produced by the method. Wound (sometimes known as compound) strings are particularly used for the lower toned strings on guitars (both acoustic and electric) and for other stringed instruments. The improved wound string 10 of the present invention is illustrated in FIGS. 3-5. Although the present preferred embodiment 10 illustrated shows a single winding only, other embodiments using multiple layers of windings are also envisioned and will produce similar benefits and results.

Figure 1:
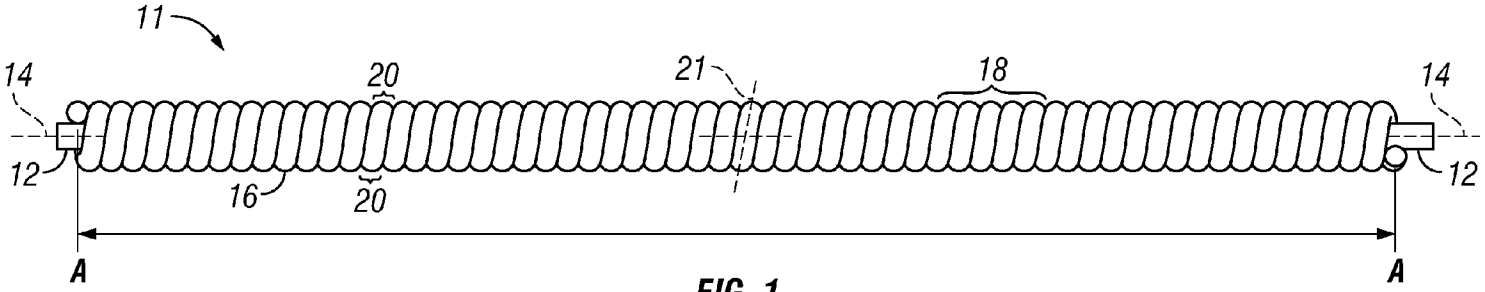
FIG. 1 (Prior Art)
FIG. 1 (prior art) is a side elevational view of a conventionally wound string using a round cover wire.

In order to illustrate the improvement of the present invention a prior art wound string 11 is shown in FIGS. 1 and 2. In the side elevational illustration of FIG. 1 it may be seen that the wound string 11 includes a center string 12 which generally defines the tone (dominant resonance frequency) of the resulting string 11. In wound strings the center string 12 is also often referred to as the "core wire" since in the majority of embodiments the actual components are ordinarily formed of metal wire. A longitudinal axis 14 (shown by the dotted line) is defined by the center of the taut center string 12. The wound string 11 is generally radially symmetrical about the longitudinal axis 14. A cover wire 16 is wound about the center string 12 in a spiral winding pattern 18 so as to have a single thickness in this embodiment, although multi-thickness embodiments are also produced. A single turn of the winding pattern is referred to herein as an iteration 20 (or sometimes simply as a "wrap"). The particular angle at which the inclination of the cover wire 16 during an iteration 20 intersects the longitudinal axis 14 is referred to herein as a wrap angle 21, also known as a "serve angle".

Figure 2A:
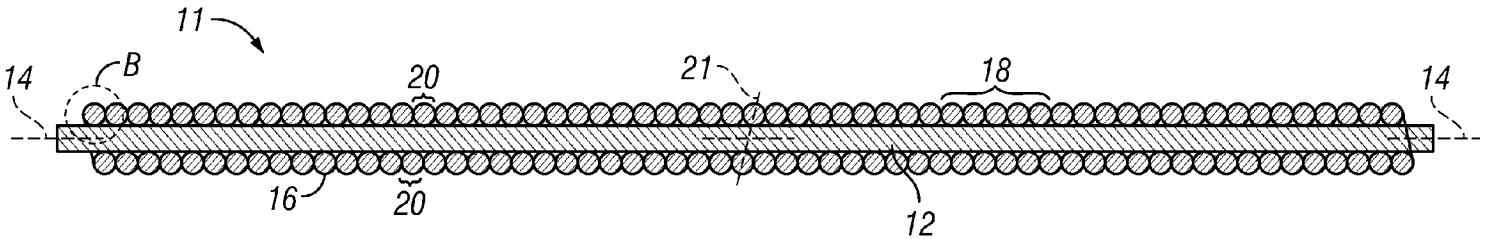
FIG. 2A (Prior Art)
FIG. 2A (prior art) is a cross sectional view taken along line A-A of FIG. 1.
Figure 2B:
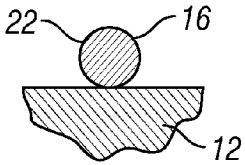
FIG. 2B (Prior Art)
FIG. 2B (prior art) is a cross sectional detail view, taken along arc B of FIG. 2A, showing a portion of the central string and cover wire.

The cross sectional view of FIG. 2A shows the wound string 11 of FIG. 1 as viewed in a transverse plane including the longitudinal axis 14. The detailed cross sectional view of FIG. 2B shows a single occurrence of the cover wire 16. In these illustrations it may be seen that the prior art conventional cover wire 16 is completely round and has a wire diameter 22 which is consistent throughout. The wire diameter 22 defines the spacing (longitudinal dimension) of each iteration 20 and consequently the density of the cover wire 16 in the spiral winding pattern 18 and the magnitude of the wrap angle 21. For the illustration of FIGS. 1 and 2, the wound string 11 is a typical low E string for an acoustic guitar (adapted for a principal resonance frequency of 84 Hz), the center string 12 selected has a diameter of 0.508 mm (0.020 in) while the cover wire 16 has a post-winding wire diameter 22 of 0.419 mm (0.0165 in) so the total diameter of the wound string is 1.35 mm (0.0530 in).

Figure 4A:
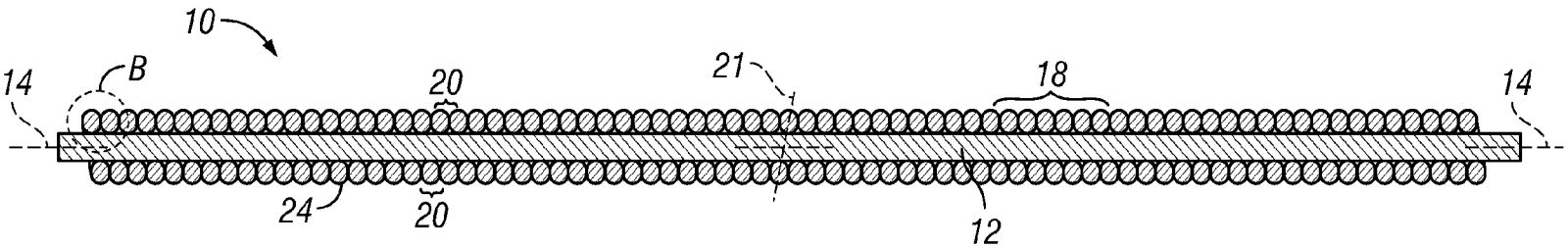
FIG. 4A is a cross sectional view of the wound string of the present invention, taken along line A-A of FIG. 3.
Figure 4B:
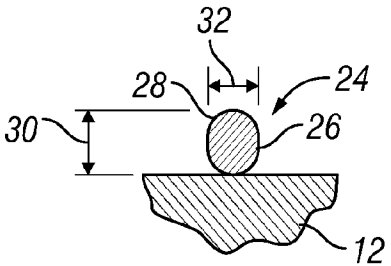
FIG. 4B is a cross sectional detail view, taken along arc B of FIG. 4A, showing a portion of the central string and hyper elliptical shaped cover wire.
Figure 5:
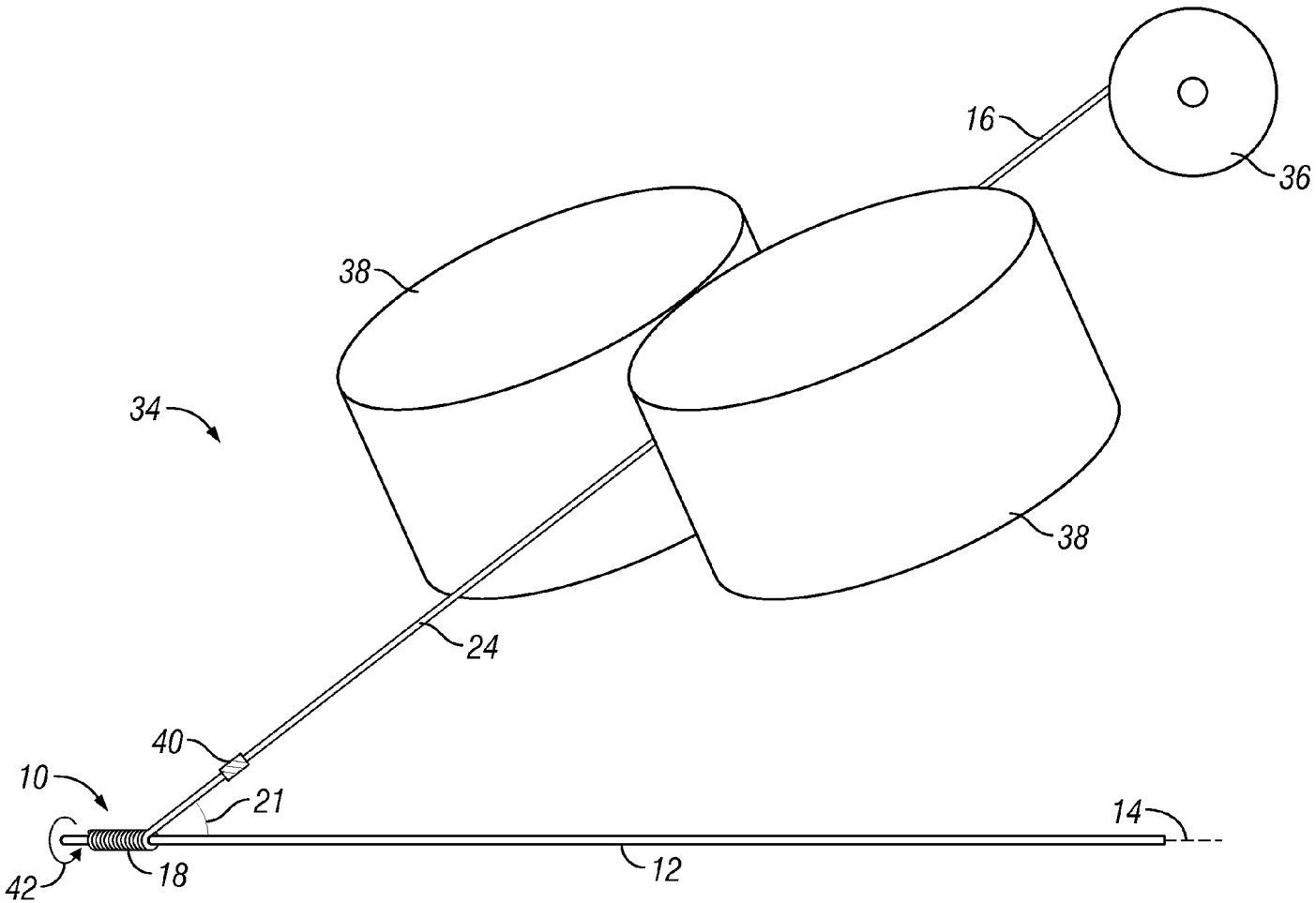
FIG. 5 is a fanciful view of the winding system for achieving the wound string of the present invention, showing the pinch rollers.

Referring now to FIGS. 3 and 4, the wound musical string assembly 10 of the present invention is illustrated in views corresponding to those shown in FIGS. 1 and 2. The center string 12 and the longitudinal axis 14 are unchanged. However, the cover wire 16 of the prior art has been replaced by a shaped cover wire 24 in accordance with the present invention. The use of the shaped cover wire 24 has a profound impact on the spiral winding pattern 18, the individual iterations 20, and the wrap angle 21. As shown in the illustration of FIG. 5 the winding system modifies wire such that the dimensions of the shaped cover wire 24 are altered from those of the round cover wire 16 of the prior art to change the characteristics of the spiral winding pattern 18. These changes are particularly evident in FIGS. 4A and 4B.

The shaped cover wire 24 is no longer round in cross section but has been modified to a generally hyper elliptical or pseudo-rectangular cross section with chamfered corners such that it now has distinct opposed sides 26 and ends 28. The shaped cover wire 24 now also has a wire height 30 and a wire thickness 32, as opposed to a consistent diameter. The pre-shaping cover wire 16 (the same as illustrated in FIGS. 1 and 2), is modified into the shaped cover wire 24 so that, in particular, the wire thickness 32 is less than the prior diameter 22. The relatively flat sides 26 are also carefully aligned by the winding process such that they abut with adjacent windings throughout each iteration 20 in the spiral winding pattern 18 with the ends 26 being aligned perpendicularly with the longitudinal axis 14, thus reducing the total width of each iteration 20. This also results in a steeper wrap angle 21.

Although the sides 26 are relatively flat they do not have sharp edges which could lead to dissonance or degradation of the wire. It is also important to retain at least minimal convexity, since a concave shaping of the sides would prevent the most desirable abutment. Further, it is generally desired that the ends 28 be somewhat rounded so as to abut against the center string 12 in a manner which does not result in unwarranted friction.

FIG. 5 illustrates, in a fanciful perspective view, a winding mechanism 34 for achieving the improved wound string 10. This illustration is not at all to scale and illustrates several components in completely fanciful manners since those details are not completely germane to the present invention. Other methods of creating the shaped cover wire 24 are feasible, but the general form of winding mechanism 34 illustrated is believed to be the most elegant.

In the winding mechanism 34, the original cover wire 16 is delivered to the mechanism from a spool 36 and is then fed through a pair pinch rollers 38, which squeeze the wire in order to reshape it into the configuration of the shaped cover wire 24. The shaped cover wire 24 is then fed through one or more aligners 40 and to the center string 12, which is being turned by a spinner 42 in such a manner as to draw the wire from the spool 36 and through the pinch rollers 38 and the aligners 40 to be deposited on the center string 12 in the spiral winding pattern 18. The aligners 40 maintain the orientation of the shaped cover wire 24 such that the sides 32 will remain precisely aligned with the desired wrap angle 21, thus insuring closest packing of each iteration 20.

In this manner the wire height 30 dimension will always be greater than the wire width 32 dimension in the shaped cover wire 24. Since the improved wound string 10 is always wrapped with the wire height 30 being perpendicular to the center string 12 and the longitudinal axis 14, a greater height to width ratio is maintained along the entire length of the string 10 than in the prior art.

The function of the pinch rollers 38 is to both squeeze the cover wire 16 out of its round cross sectional shape and also to provide substantial tension in the extent between the pinch rollers 38 and the center string 12. As a result, the wire is elongated (stretched) during this extent, which also attenuates it such that the cross sectional dimensions are modified during the winding process.

In the exemplification illustrated in the FIGS. 3 and 4, the center string 12 is high carbon, high tensile steel wire and is not elongated during the process. The preferred cover wire 16 is formed of customized bronze having an original diameter 22 of 0.432 mm (0.170 in) before it enters the pinch rollers 38. Within the pinch rollers 38 the dimensions are altered such that the wire would have a wire height of 30 of 0.475 mm (0.0187 in) and a wire width 32 of 0.389 mm (0.153 in). The wire is then attenuated by the extruding force acting on it upon exiting the pinch rollers 38 to achieve final dimensions with a wire height 30 of 0.419 mm (0.0165 in) and a wire width 32 of 0.333 mm (0.0131 in) as the shaped cover wire 24.

It is noted that even in the case of the prior art string 11 of FIGS. 1 and 2 some attenuation occurs. That cover wire 16 also starts at a diameter of 0.475 mm (0.0170 in) and ends at 0.419 mm (0.0165 in). The attenuation is greater in the present invention example 10 because the tension applied to achieve attenuation is greater. In both cases, the total diameter (wire height) of the completed string [1.35 mm (0.530 in)] remains the same so the overall thickness dimension (perpendicular to axis 14) is the same, for compatibility with instruments and (even more importantly) with the musicians who play them.

For the given examples the prior art technique results in a string 11 which, when tuned to 84 Hz, has a spiral winding pattern 18 having 23.9 iterations (wraps) 20 per centimeter (60.6 per inch). Conversely, the wound musical instrument string with hyper elliptical wound cover wire 10 tuned to the same frequency results in a spiral winding pattern 18 having 30.0 iterations 20 per centimeter (76.3 per inch). This represents an approximately 25% increase in cover wire mass.

Of course, each type of wound instrument string will have different dimensional characteristics, depending on the results and frequencies desired. Further, different materials affect performance. Therefore, each type of string will require modification of the parameters to achieve the desired outcome. In each case, however, the benefits of the shaped cover wire 24 and the closely aligned and more tightly packed spiral wrapping patterns 18 is achieved by the present invention 10.

As mentioned above, the center string 12 (core material) is typically a non-elongating metal such as steel. Other materials are utilized for specific applications (e.g. nylon for classical guitar strings). The center string 12 will generally be a uniformly round shape for best acoustical performance, although hexagonal cross-section center strings are also used. Similarly the stretchable and deformable cover wire can be formed of numerous metallic alloys (other materials are not presently commonly used).

The above embodiment deals with a single layer wound string. However, the results are similar with multi-layer wound strings such as are used for bass guitars.

Many modifications to the above embodiment may be made without altering the nature of the invention. The dimensions and shapes of the components and the construction materials may be modified for particular circumstances.

While various embodiments have been described above, it should be understood that they have been presented by way of example only, and not as limitations.

INDUSTRIAL APPLICABILITY

The musical instrument string with hyper elliptical wound cover wire 10 of the present invention is intended for use in any sort of wound musical instrument string application where improved performance is desired. The materials, tensions and mass of the strings affect the timbre and "voice" of the string when played. Increasing the density of the string by the use of the wound strings 10 of the present invention modifies the musical voice in subtle but significant ways. Wound strings 10 of the present invention are branded as the HELIX HD™ strings by Dean Markley Strings, Inc. of Santa Clara, Calif.

Testing has shown that the wound strings 10 of the present invention have distinctive mid-range voicing and improved presence in all of the harmonic frequencies. The degree of contact between the shaped cover wire 24 and the center string 12 also results in an improved damping effect on the string, resulting in a "mellower" tonality.

The tighter spiral winding pattern 18 of the present invention is further desirable to many instrumentalists from a tactile perspective, since there are smaller gaps between wraps and a more uniform "feel" results. The tighter spacing between adjacent windings results in less room for suboptimal contact, thus resulting in greatly reduced "finger noise". Further, the string 10 will have the same standard diameter as prior strings, but with improved tonal qualities as a result of greater mass.

When used with electrical instruments (or acoustic instruments provided with electro-magnetic amplification) the greater mass density of the improved wound string 10 results in improved performance. Since a higher mass density of electromagnetically active shaped cover wire 24 will be present in the vicinity of a pick-up, a stronger signal will be generated thereby.

For the above, and other, reasons, it is expected that the improved wound musical instrument string 10 of the present invention will have widespread industrial applicability. Therefore, it is expected that the commercial utility of the present invention will be extensive and long lasting.

What is claimed is:

1. A wound musical instrument string, comprising:

a center string; and a cover wire wound in a spiral winding pattern about said center string, wherein said cover wire is shaped to have a cross section with generally flat opposing sides and rounded opposing ends and with a wire height which is greater than a wire width; and said cover wire is arrayed within said spiral winding pattern such that said wire height is arrayed generally perpendicularly to said center string.

2. The wound instrument string of claim 1, wherein said cover wire is hyper elliptical in cross sectional shape.

3. The wound instrument string of claim 1, wherein said cover wire has flattened non-concave sides and rounded ends.

4. The wound instrument string of claim 3, wherein said cover wire has chamfered interfaces between said sides and said ends.

5. The wound instrument string of claim 1, wherein said spiral winding pattern is closely wound with adjacent iterations being as tightly spaced as possible with said opposing sides abutting against those of adjacent iterations.

6. The wound instrument string of claim 1, wherein said cover wire is shaped by extrusion between pinch rollers.

7. In a wound string for musical instruments formed by a center string and a cover wire forming a spiral winding pattern about the center string, the improvement comprising:

pre-shaping said cover wire to have a hyper elliptical cross sectional shape with flattened opposing sides and rounded opposing ends and with a wire height which is greater than a wire width; and orienting said cover wire within said spiral winding pattern such that said wire height is arrayed generally perpendicularly to said center string.

8. The improvement of claim 7, wherein said winding pattern includes a plurality of adjacent winding iterations, with said flattened opposing sides abutting against those of respective adjacent winding iterations.

9. The improvement of claim 7, wherein said cover wire is pre-shaped by extrusion of a circular cross section initial wire between pinch rollers.

10. The improvement of claim 7, wherein said pre-shaped cover wire has an approximate wire height to wire width ratio of 1.25 to 1.

11. The improvement of claim 7, wherein said cover wire is formed of customized bronze.

12. The improvement of claim 7, wherein said flattened opposing sides are arrayed to be generally perpendicular to a longitudinal axis defined by said center string.

13. A method for forming a wound string for musical instruments, in steps comprising:

stretching a center string on a rotating mechanism to rotate said center string about a longitudinal axis;

passing a round wire between an opposed pair of pinch rollers so as to form a shaped cover wire characterized by having a generally hyper elliptical shape with flatter opposing sides and rounder opposing ends and having a greater end to end cross-sectional dimension than a side to side cross-sectional dimension; and attaching said shaped cover wire to said center string and winding said cover wire about said center string in a spiral winding pattern wherein said shaped cover wire is maintained in an orientation where said ends are arrayed perpendicularly to said center string throughout said spiral winding pattern.

14. The method of claim 13, wherein said cover wire is attenuated by stretching between said pinch rollers and said center string.

15. The method of claim 13, wherein said pinch rollers form said cover wire to have non-concave opposing sides and rounded opposing ends with a smooth chamfered interface.

16. The method of claim 13, wherein said spiral winding pattern is as tight as feasible such that in adjacent iterations said opposing sides closely abut.

* * * * *